US010268139B2

(12) United States Patent
Nakayama

(10) Patent No.: US 10,268,139 B2
(45) Date of Patent: Apr. 23, 2019

(54) DEVELOPER HOUSING CONTAINER WITH A COMMUNICATION MECHANISM THAT DEFORMS A SEAL ON A MOVING WALL TO ALLOW COMMUNICATION BETWEEN AREAS UPSTREAM AND DOWNSTREAM OF THE MOVING WALL AND IMAGE FORMING DEVICE PROVIDED WITH SAME

(71) Applicant: KYOCERA Document Solutions Inc., Osaka-shi (JP)

(72) Inventor: Toru Nakayama, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 16/011,758

(22) Filed: Jun. 19, 2018

(65) Prior Publication Data

US 2018/0373179 A1 Dec. 27, 2018

(30) Foreign Application Priority Data

Jun. 23, 2017 (JP) ..... 2017-122958

(51) Int. Cl.
*G03G 15/08* (2006.01)
*G03G 15/10* (2006.01)
*G03G 15/16* (2006.01)

(52) U.S. Cl.
CPC ..... *G03G 15/087* (2013.01); *G03G 15/0881* (2013.01); *G03G 15/104* (2013.01); *G03G 15/1615* (2013.01)

(58) Field of Classification Search
CPC ..... G03G 15/0865; G03G 15/0867; G03G 15/087; G03G 15/104; G03G 15/0881; G03G 15/0877
USPC ..... 399/106, 258, 262, 263
See application file for complete search history.

(56) References Cited

U.S. PATENT DOCUMENTS 8,923,734 B2 * 12/2014 Abler et al. ..... G03G 15/0877 399/262
9,146,502 B1 * 9/2015 Eto ..... G03G 15/0865
9,983,507 B1 * 5/2018 Park et al. ..... G03G 15/0868
2015/0185661 A1 7/2015 Eto

FOREIGN PATENT DOCUMENTS

JP 2015-125333 7/2015

* cited by examiner

*Primary Examiner* — William J Royer
(74) *Attorney, Agent, or Firm* — Gerald E. Hespos; Michael J. Porco; Matthew T. Hespos

(57) ABSTRACT

A developer housing container includes a container main body, a moving wall, a sealing member, and at least one communicating mechanism. The container main body has an inner circumference surface which defines an internal space tubularly extending, and is provided with a developer discharge port. The moving wall has an outer circumference surface arranged to be opposed to the inner circumference surface, and a transport surface which defines a housing space. The moving wall moves in a first direction while transporting the developer toward the developer discharge port. At least one communicating mechanism is arranged at a predetermined position in the first direction in the container main body and allows the housing space and the internal space positioned more upstream of the moving wall in the first direction to communicate with each other by partly deforming the sealing member.

11 Claims, 16 Drawing Sheets

DEVELOPER HOUSING CONTAINER WITH A COMMUNICATION MECHANISM THAT DEFORMS A SEAL ON A MOVING WALL TO ALLOW COMMUNICATION BETWEEN AREAS UPSTREAM AND DOWNSTREAM OF THE MOVING WALL AND IMAGE FORMING DEVICE PROVIDED WITH SAME

The present application claims priority from Japanese Patent Application No. 2017-122958 filed on Jun. 23, 2017, disclosure of which is all incorporated herein.

BACKGROUND

The present disclosure relates to a developer housing container which houses a developer, and an image forming device including the same.

There has been conventionally known a developer housing container provided in an image forming device as a developer housing container which houses a developer. The image forming device includes an image carrier, a developing device, and a developer housing container. When a developer is supplied from the developing device to the image carrier, an electrostatic latent image formed on the image carrier appears as a developer image. The developer housing container includes a developer discharge port and supplies a replenishing developer to a replenishing port provided in the developing device.

There has been also known a developer housing container including a moving wall which moves while transporting a developer toward a developer discharge port.

In the developer housing container, an internal space in a container main body is divided by the moving wall. Since a housing space that houses a developer is reduced as the moving wall moves, an internal pressure in the housing space is increased. By contrast, a space upstream of the moving wall is enlarged to have a reduced internal pressure.

SUMMARY

A developer housing container according to one aspect of the present disclosure includes a container main body, a moving wall, a sealing member, and at least one communicating mechanism. The container main body has an inner circumference surface which defines an internal space tubularly extending along a first direction. The container main body is provided with a developer discharge port which is opened so as to communicate with the internal space and allows a developer to be discharged. The moving wall has an outer circumference surface arranged to be opposed to the inner circumference surface of the container main body, and a transport surface that defines, together with the inner circumference surface of the container main body, a housing space in which the developer is housed. The moving wall moves in the first direction in the internal space while transporting the developer in the housing space toward the developer discharge port. The sealing member is arranged over an entire circumference direction of the moving wall along the outer circumference surface of the moving wall, and is compressively deformed between the inner circumference surface of the container main body and the moving wall. At least one communicating mechanism is arranged at a predetermined position in the first direction in the container main body and allows the housing space and the internal space upstream of the moving wall in the first direction to communicate with each other by partly deforming the sealing member.

DETAILED DESCRIPTION

Figure 1:
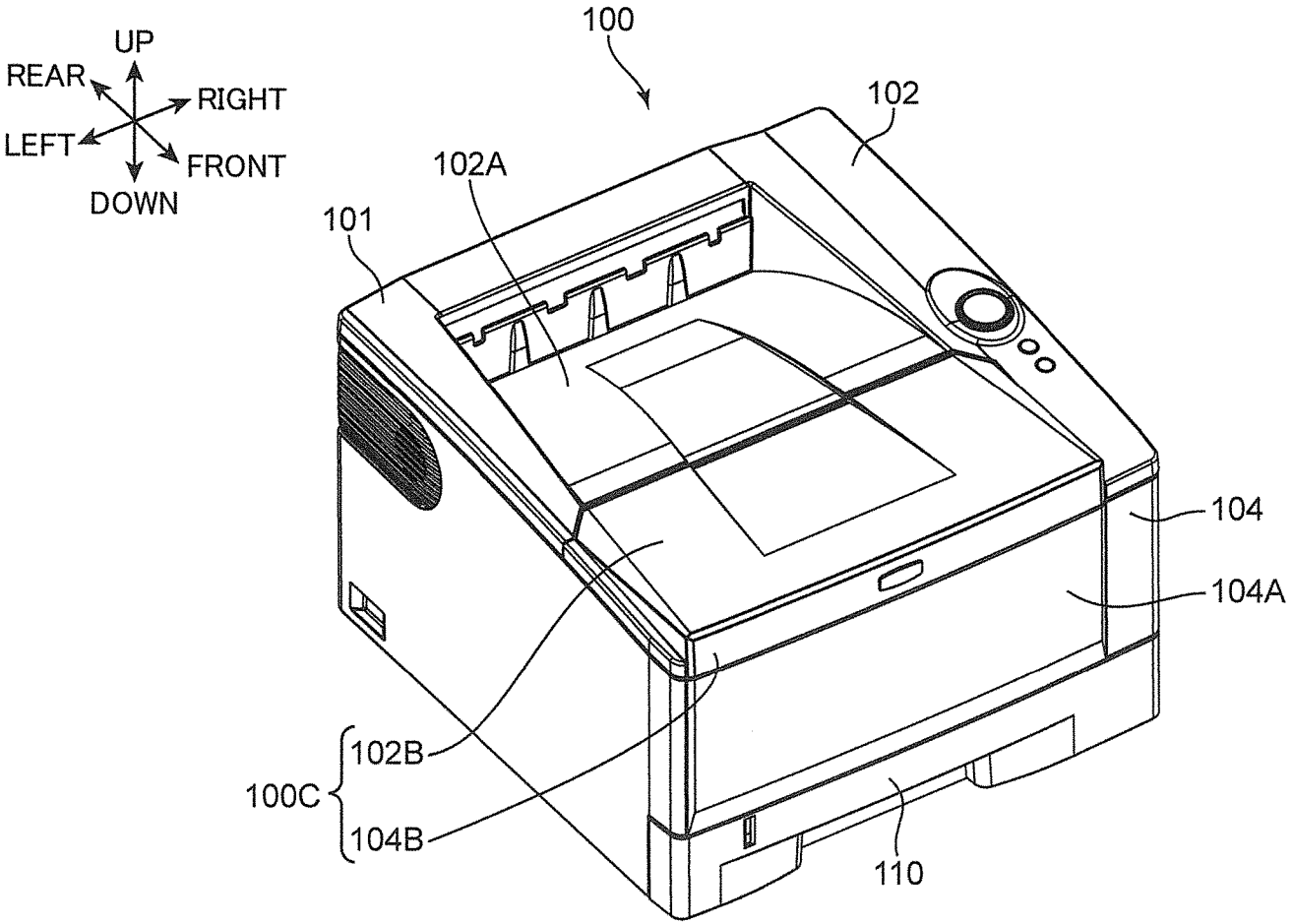
FIG. 1 is a perspective view showing an image forming device according to one embodiment of the present disclosure.
Figure 2:
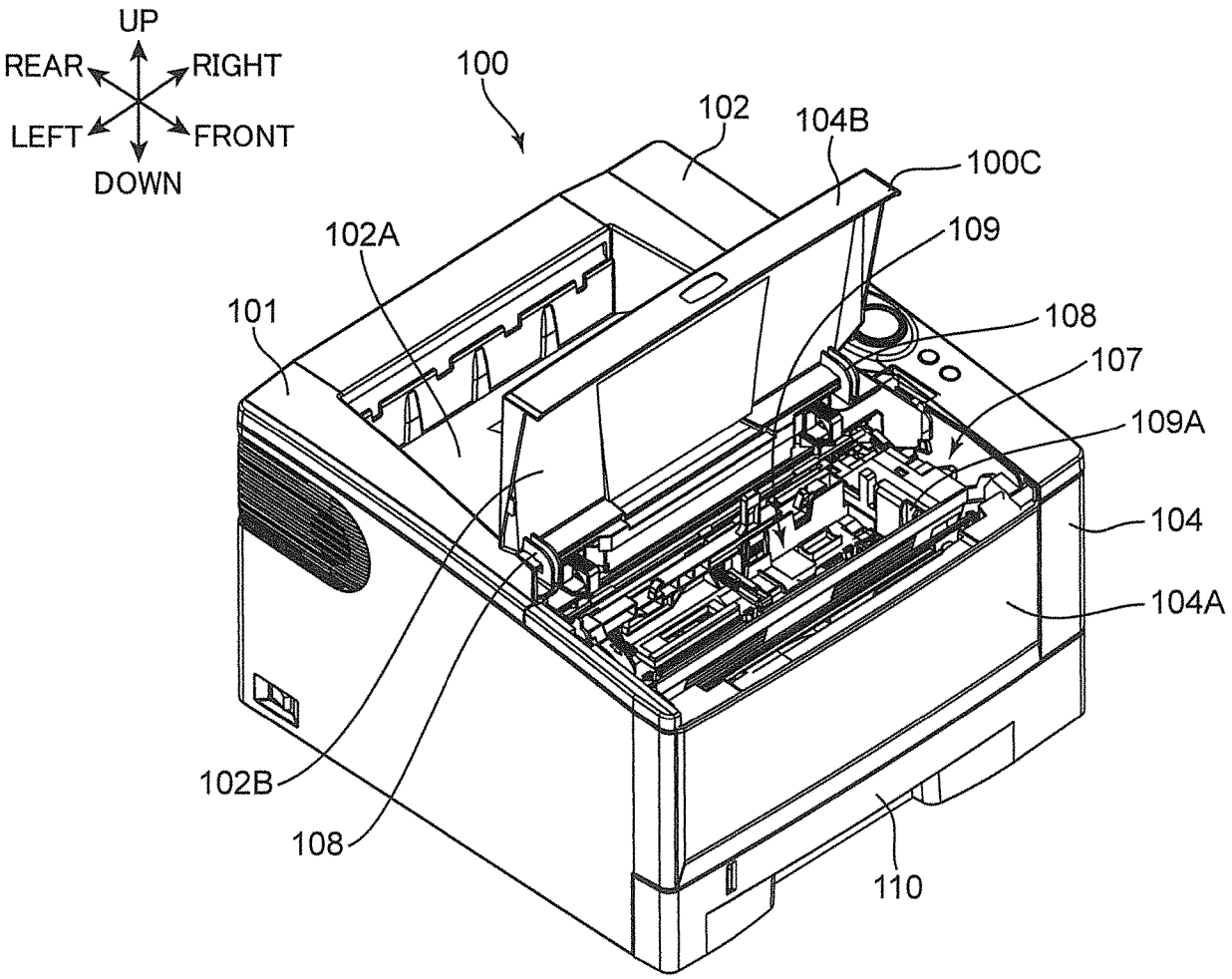
FIG. 2 is a perspective view showing the image forming device according to one embodiment of the present disclosure, with a part of the image forming device opened.
Figure 3:
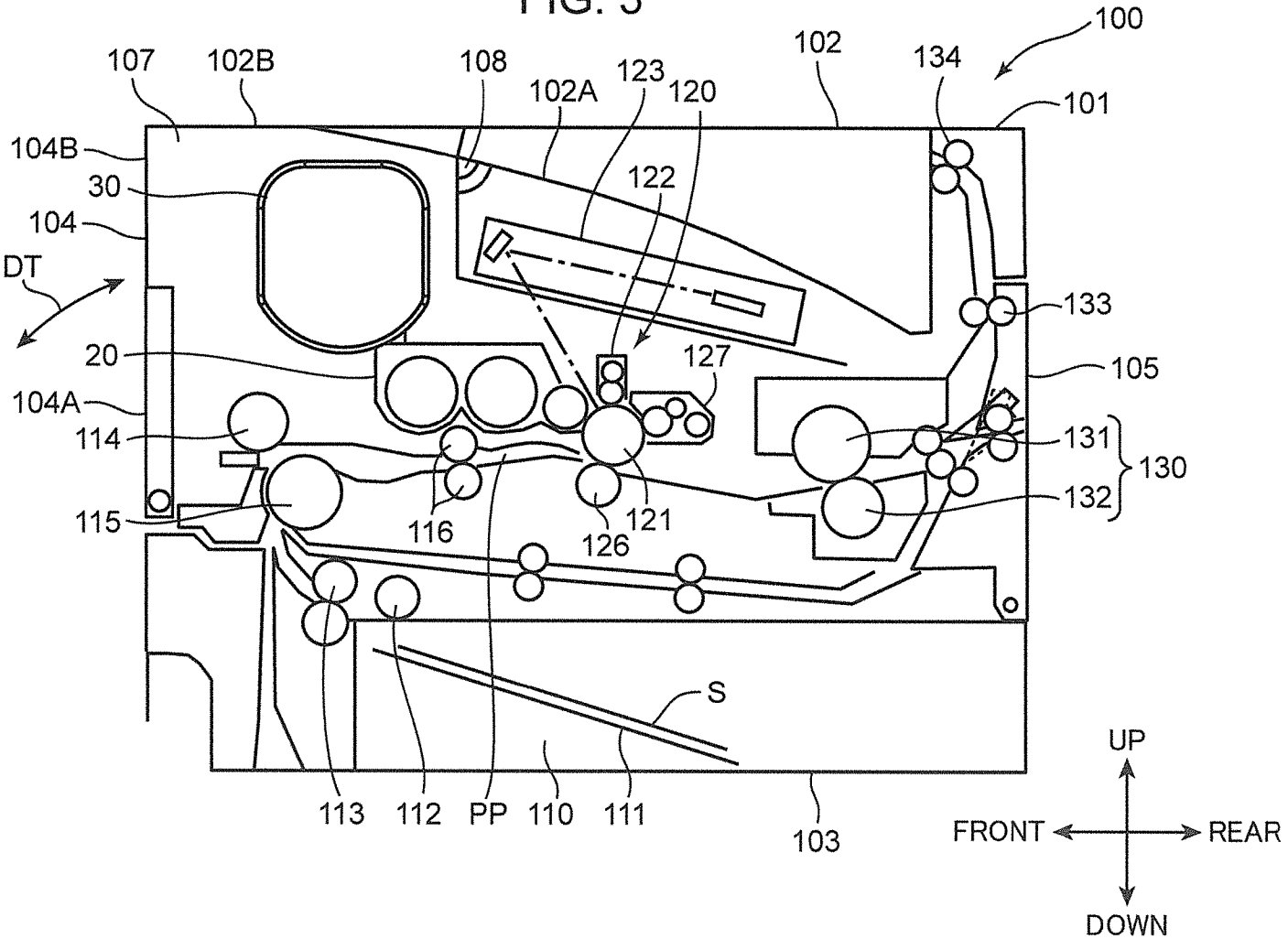
FIG. 3 is a schematic sectional view showing an internal structure of the image forming device according to one embodiment of the present disclosure.

In the following, one embodiment of the present disclosure will be described with reference to the drawings. FIG. 1 and FIG. 2 are perspective views of a printer 100 (an image forming device) according to one embodiment of the present disclosure. FIG. 3 is a sectional view schematically showing an internal structure of the printer 100 shown in FIG. 1 and FIG. 2. Although the printer 100 as an image forming device shown in FIG. 1 to FIG. 3 is a so-called monochrome printer, the image forming device in other embodiment may be a color printer, a facsimile machine, a multifunctional machine equipped with these functions, or other device which forms a toner image on a sheet. Note that terms representing directions such as "up" and "down", "front" and "rear", and "right" and "left" in the following description are used simply for clarifying the explanation, but do not limit a principle of an image forming device.

The printer 100 includes a casing 101 which houses various devices for forming an image on a sheet S. The casing 101 includes an upper wall 102 which defines an upper face of the casing 101, a bottom wall 103 which defines a bottom face of the casing 101 (FIG. 3), a main body rear wall 105 between the upper wall 102 and the bottom wall 103 (FIG. 3), and a main body front wall 104 positioned ahead of the main body rear wall 105. The casing 101 includes a main body internal space 107 in which various kinds of devices are arranged. In the main body internal space 107 of the casing 101, a sheet transport path PP is provided to extend on which the sheet S is transported in a predetermined transportation direction. The printer 100 also includes an opening/closing cover 100C attached to the casing 101 to be freely opened or closed.

The opening/closing cover 100C is configured with a front wall upper portion 104B as an upper part of the main body front wall 104, and an upper wall front portion 102B as a front part of the upper wall 102. The opening/closing cover 100C is capable of opening/closing in an up-down direction with a hinge shaft (not shown) as a supporting point, the hinge shaft being arranged in a pair of arm portions 108 arranged in both end portions of the opening/closing cover 100C in a right and left direction (FIG. 2). With the opening/closing cover 100C opened, the upper part of the main body internal space 107 is opened to the outside. On the other hand, with the opening/closing cover 100C closed, the upper part of the main body internal space 107 is closed In a center part of the upper wall 102, a sheet ejection portion 102A is arranged. The sheet ejection portion 102A is formed of an inclination surface inclining downward from a front part to a rear part of the upper wall 102. In an image forming portion 120 to be described later, the sheet S on which an image is formed is ejected to the sheet ejection portion 102A. In a center part of the main body front wall 104 in the up-down direction, a manual feeding tray 104A is arranged. The manual feeding tray 104A is vertically turnable with a lower end thereof as a supporting point (an arrow DT in FIG. 3).

With reference to FIG. 3, the printer 100 includes a cassette 110, a pickup roller 112, a first sheet feeding roller 113, a second sheet feeding roller 114, a transport roller 115, a resist roller pair 116, the image forming portion 120, and a fixing device 130.

The cassette 110 houses the sheet S inside. The cassette 110 includes a lift plate 111. The lift plate 111 inclines so as to push up a leading edge of the sheet S. The cassette 110 is configured to be drawable forward of the casing 101.

The pickup roller 112 is arranged above the leading edge of the sheet S pushed up by the lift plate 111. When the pickup roller 112 rotates, the sheet S is drawn from the cassette 110.

The first sheet feeding roller 113 is disposed downstream of the pickup roller 112 to send out the sheet S further downstream. The second sheet feeding roller 114 is disposed on an inner side (rear side) of the supporting point DT of the manual feeding tray 104A to draw the sheet S on the manual feeding tray 104A into the casing 101.

The transport roller 115 is disposed downstream of the first sheet feeding roller 113 and the second sheet feeding roller 114 in the sheet transportation direction. The transport roller 115 transports the sheet S further downstream, the sheet being sent by the first sheet feeding roller 113 and the second sheet feeding roller 114.

The resist roller pair 116 has a function of correcting oblique transport of the sheet S. This enables adjustment of a position of an image formed on the sheet S. The resist roller pair 116 supplies the sheet S to the image forming portion 120 at the timing of image forming by the image forming portion 120.

The image forming portion 120 includes a photosensitive drum 121 (an image carrier), a charger 122, an exposure device 123, a developing device 20, a toner container 30 (a developer housing container), a transfer roller 126 (a transfer portion), and a cleaning device 127.

The photosensitive drum 121 has a tubular shape. The photosensitive drum 121 has a surface on which an electrostatic latent image is formed and carries a toner image (a developer image) corresponding to the electrostatic latent image on the surface. The charger 122 is applied a predetermined voltage to generally uniformly charge a circumference surface of the photosensitive drum 121. The exposure device 123 radiates laser light to the circumference surface of the photosensitive drum 121 charged by the charger 122. As a result, an electrostatic latent image corresponding to image data is formed on the circumference surface of the photosensitive drum 121.

The developing device 20 supplies a toner to the circumference surface of the photosensitive drum 121 on which an electrostatic latent image is formed. The toner container 30 supplies a toner (a replenishing developer) to the developing device 20. The toner container 30 is disposed to be attachable and detachable to/from the developing device 20. When the developing device 20 supplies a toner to the photosensitive drum 121, an electrostatic latent image formed on the circumference surface of the photosensitive drum 121 is developed (visualized). As a result, a toner image (a developer image) is formed on the circumference surface of the photosensitive drum 121.

The transfer roller 126 is arranged below the photosensitive drum 121 so as to be opposed to the photosensitive drum 121 with the sheet transport path PP provided therebetween. The transfer roller 126 forms a transfer nip portion with the photosensitive drum 121 to transfer a toner image to the sheet S. The cleaning device 127 removes a toner remaining on the circumference surface of the photosensitive drum 121 after the toner image is transferred to the sheet S.

The fixing device 130 is arranged downstream of the image forming portion 120 in the transportation direction to fix a toner image on the sheet S. The fixing device 130 includes a heating roller 131 which melts a toner on the sheet S, and a pressure roller 132 which brings the sheet S into close contact with the heating roller 131.

The printer 100 further includes a transport roller pair 133 disposed downstream of the fixing device 130, and a discharge roller pair 134 disposed downstream of the transport roller pair 133. The sheet S is transported upward by the transport roller pair 133, and ultimately discharged from the casing 101 by the discharge roller pair 134. The sheet S discharged from the casing 101 is stacked on the sheet ejection portion 102A.

<Regarding Developing Device>

Figure 4:
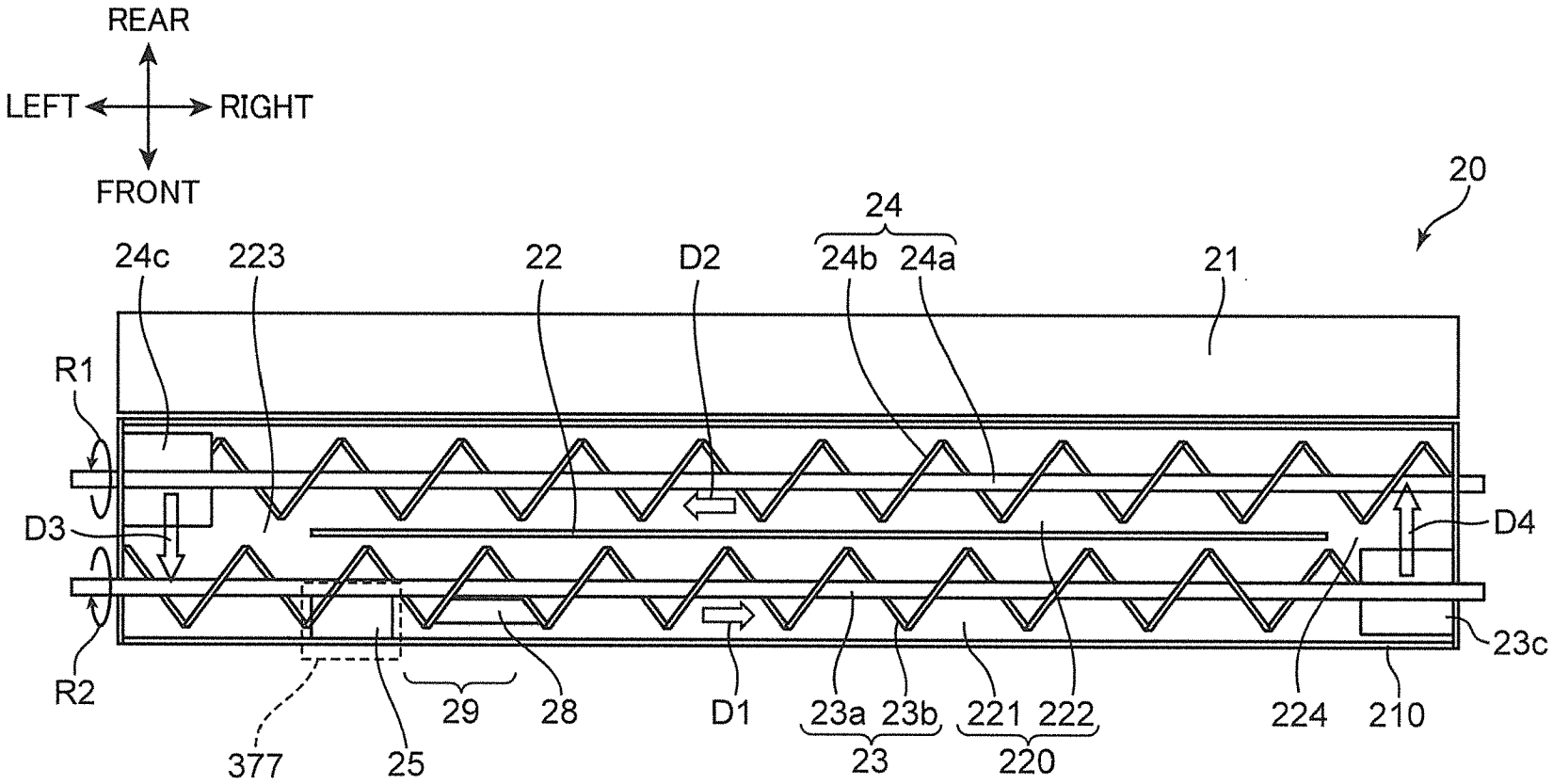
FIG. 4 is a schematic plan view showing an internal structure of a developing device according to one embodiment of the present disclosure.

FIG. 4 is a plan view showing an internal structure of the developing device 20. The developing device 20 includes a developing housing 210 (a housing) having a box-shape long in one direction (an axis direction of a developing roller 21, the right and left direction). The developing housing 210 has a storage space 220 (a developer transport path). The developing roller 21, a first stirring screw 23 (a developer transport member) and a second stirring screw 24, and a toner replenishing port 25 are disposed in the storage space 220. In the present embodiment, a one-component developing system is applied, in which the storage space 220 is filled with a toner as a developer. On the other hand, in a case of a two-component developing system, a mixture of a toner and a carrier made of a magnetic substance is filled as a developer. The toner is transported while being stirred in the storage space 220, and is successively supplied from the developing roller 21 to the photosensitive drum 121 in order to develop an electrostatic latent image.

The developing roller 21 has a tubular shape extending in a longitudinal direction of the developing housing 210 and has, on an outer circumference, a sleeve part driven to rotate. The storage space 220 of the developing housing 210 is covered with a top (not shown), and is also divided into a first transport path 221 and a second transport path 222 long in the right and left direction by a partition plate 22 extending in the right and left direction. The partition plate 22 is shorter than a width of the developing housing 210 in the right and left direction and includes, at a left end and a right end of the partition plate 22, a first communication path 223 and a second communication path 224 which allow the first transport path 221 and the second transport path 222 to communicate with each other. This leads to formation of a circulation path leading to the first transport path 221, the second communication path 224, the second transport path 222, and the first communication path 223 in the storage space 220. The toner is transported counterclockwise in the circulation path in FIG. 4.

The toner replenishing port 25 (a developer replenishing port) is an opening portion opened in the top of the developing housing 210, and is arranged above the proximity to a left end of the first transport path 221. The toner replenishing port 25 is arranged to be opposed to the above circulation path and has a function of receiving, into the storage space 220, a replenishing toner (a replenishing developer) to be replenished from a toner discharge port 377 (FIG. 4) of the toner container 30.

The first stirring screw 23 is disposed in the first transport path 221. The first stirring screw 23 includes a first rotation shaft 23*a*, and a first spiral vane 23*b* provided to project in a spiral manner on a circumference of the first rotation shaft 23*a*. The first stirring screw 23 transports a toner in a direction of an arrow D1 in FIG. 4 as a result of being rotatably driven around the first rotation shaft 23*a* (an arrow R2). The first stirring screw 23 transports a developer such that the developer passes a position in which the toner replenishing port 25 opposing to the first transport path 221. Accordingly, the first stirring screw 23 has a function of transporting a new toner flowing from the toner replenishing port 25 and a toner transported from the second transport path 222 side into the first transport path 221 while mixing the toners. A first paddle 23*c* is disposed on a downstream side of the first stirring screw 23 in the toner transportation direction (a D1 direction). The first paddle 23*c* is rotated together with the first rotation shaft 23*a* to receive and send a toner toward an arrow D4 direction in FIG. 4 from the first transport path 221 to the second transport path 222.

The second stirring screw 24 is disposed in the second transport path 222. The second stirring screw 24 includes a second rotation shaft 24*a*, and a second spiral vane 24*b* provided to project in a spiral manner on a circumference of the second rotation shaft 24*a*. The second stirring screw 24 supplies a toner to the developing roller 21 while transporting a toner in a direction of an arrow D2 in FIG. 4 as a result of being rotatably driven around the second rotation shaft 24*a* (an arrow R1). A second paddle 24*c* is disposed on a downstream side of the second stirring screw 24 in the toner transportation direction (the D2 direction). The second paddle 24*c* is rotated together with the second rotation shaft 24*a* to receive and send a toner toward an arrow D3 direction in FIG. 4 from the second transport path 222 to the first transport path 221.

The toner container 30 (FIG. 3) is arranged above the toner replenishing port 25 of the developing housing 210. The toner container 30 includes the toner discharge port 377 (FIG. 4). The toner discharge port 377 is disposed in a bottom portion 371 (FIG. 8B) of the toner container 30 so as to correspond to the toner replenishing port 25 of the developing device 20. The toner falling down from the toner discharge port 377 is replenished from the toner replenishing port 25 to the developing device 20.

<Regarding Toner Replenishment>

Figure 5:
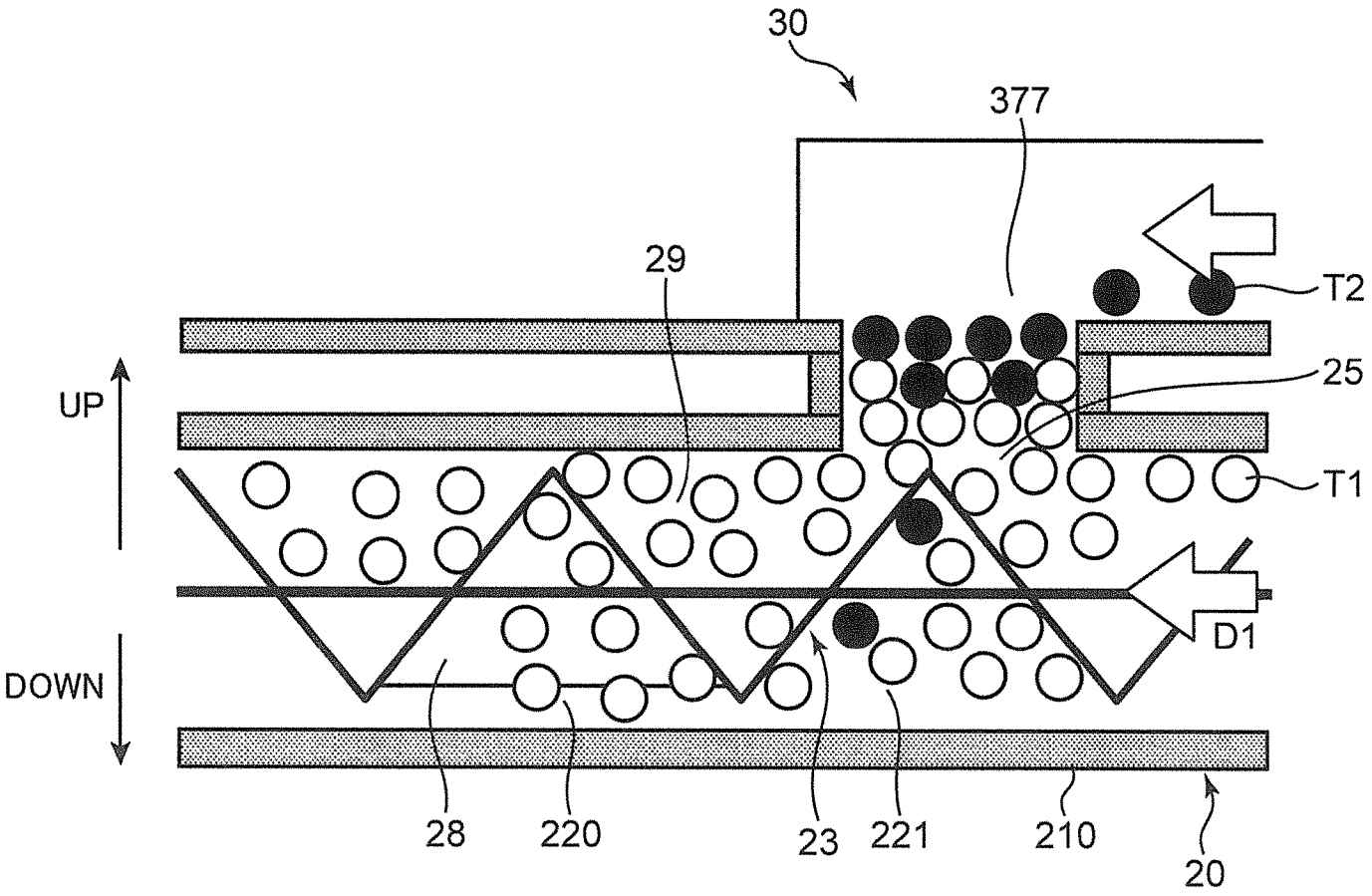
FIG. 5 is a schematic sectional view showing how the developing device according to one embodiment of the present disclosure is replenished with a developer.

Next, description will be made of a flow of a toner replenished from the toner replenishing port 25. FIG. 5 is a sectional view showing a proximity of the toner replenishing port 25 disposed in the developing device 20 and the toner discharge port 377 disposed in the toner container 30.

A replenishing toner T2 supplied from the toner discharge port 377 of the toner container 30 falls down to the first transport path 221 to be mixed with an existing toner T1 and transported in the arrow D1 direction by the first stirring screw 23. On this occasion, the toners T1 and T2 are stirred and charged.

The first stirring screw 23 includes a suppression paddle 28 (a transport capacity suppressing portion) which partly suppresses a developer transport capacity, the suppression paddle 28 being provided on the downstream of the toner replenishing port 25 in the toner transportation direction. In the present embodiment, the suppression paddle 28 is a plate-shaped member arranged between the adjacent first spiral vanes 23*b* of the first stirring screw 23. Rotation of the suppression paddle 28 around the first rotation shaft 23*a* causes a toner transported from the side upstream of the suppression paddle 28 to start retention. Then, the retention of the toner is accumulated to a position which is immediately upstream of the suppression paddle 28 and at which the toner replenishing port 25 is opposed to the first transport path 221. As a result, near an entrance of the toner replenishing port 25, a retention part 29 of a developer (a developer retention part) is formed. The first spiral vane 23*b* is arranged in a region opposed to the toner replenishing port 25 (FIG. 4). In another embodiment, the transport capacity suppressing portion may be formed by a region obtained as a partly missing part of the first spiral vane 23*b* of the first stirring screw 23, in which region the first rotation shaft 23*a* is partly exposed along the axis direction. Also in such a configuration, a transport capacity of the first stirring screw 23 is partly suppressed, resulting in forming a developer retention part.

When the replenishing toner T2 is replenished from the toner replenishing port 25 to increase an amount of a toner in the storage space 220, retention of the toner in the retention part 29 blocks (seals) the toner replenishing port 25 to suppress further replenishment of a toner. The first spiral vane 23*b* being rotated pushes up a developer in the storage space 220 around the toner replenishing port 25. As a result, sealing effect of the toner replenishing port 25 by the retention part 29 is increased. Thereafter, when the toner in the storage space 220 is consumed from the developing roller 21 to reduce toner retention in the retention part 29, the amount of the toner blocking the toner replenishing port 25 is reduced to generate a gap between the retention part 29 and the toner replenishing port 25. As a result, the replenishing toner T2 again flows into the storage space 220 from the toner replenishing port 25. Thus, the present embodiment adopts a volume replenishment type toner replenishing system in which an amount of a replenishing toner to be received is adjusted as the toner retention in the retention part 29 is reduced. Therefore, even if a sensor sensing an amount of a toner is not provided in the developing housing 210 of the developing device 20, a toner can be replenished to the developing device 20.

<Regarding Attachment of Toner Container to Developing Device>

Figure 6:
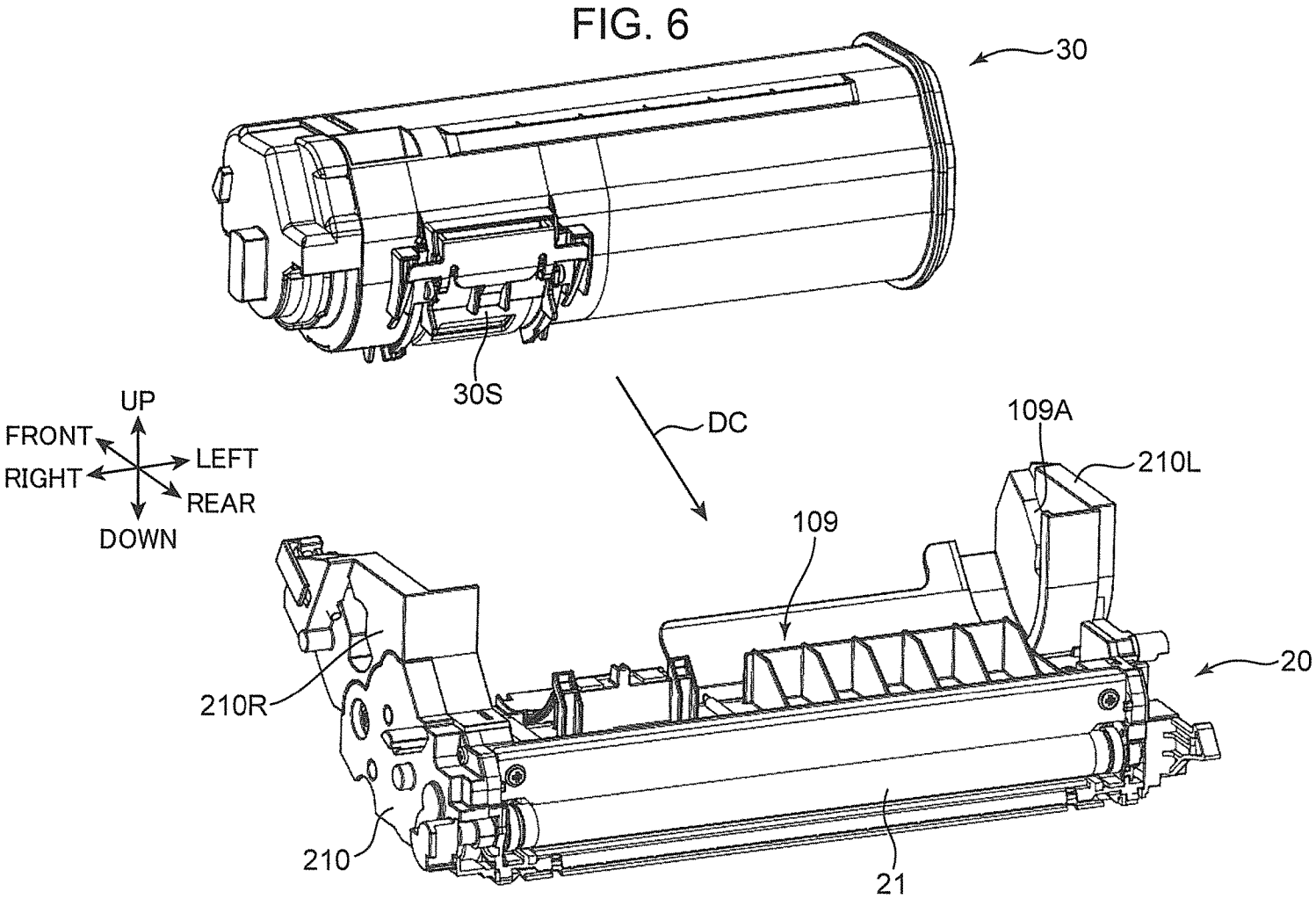
FIG. 6 is a perspective view of a developer housing container and the developing device according to one embodiment of the present disclosure.
Figure 7:
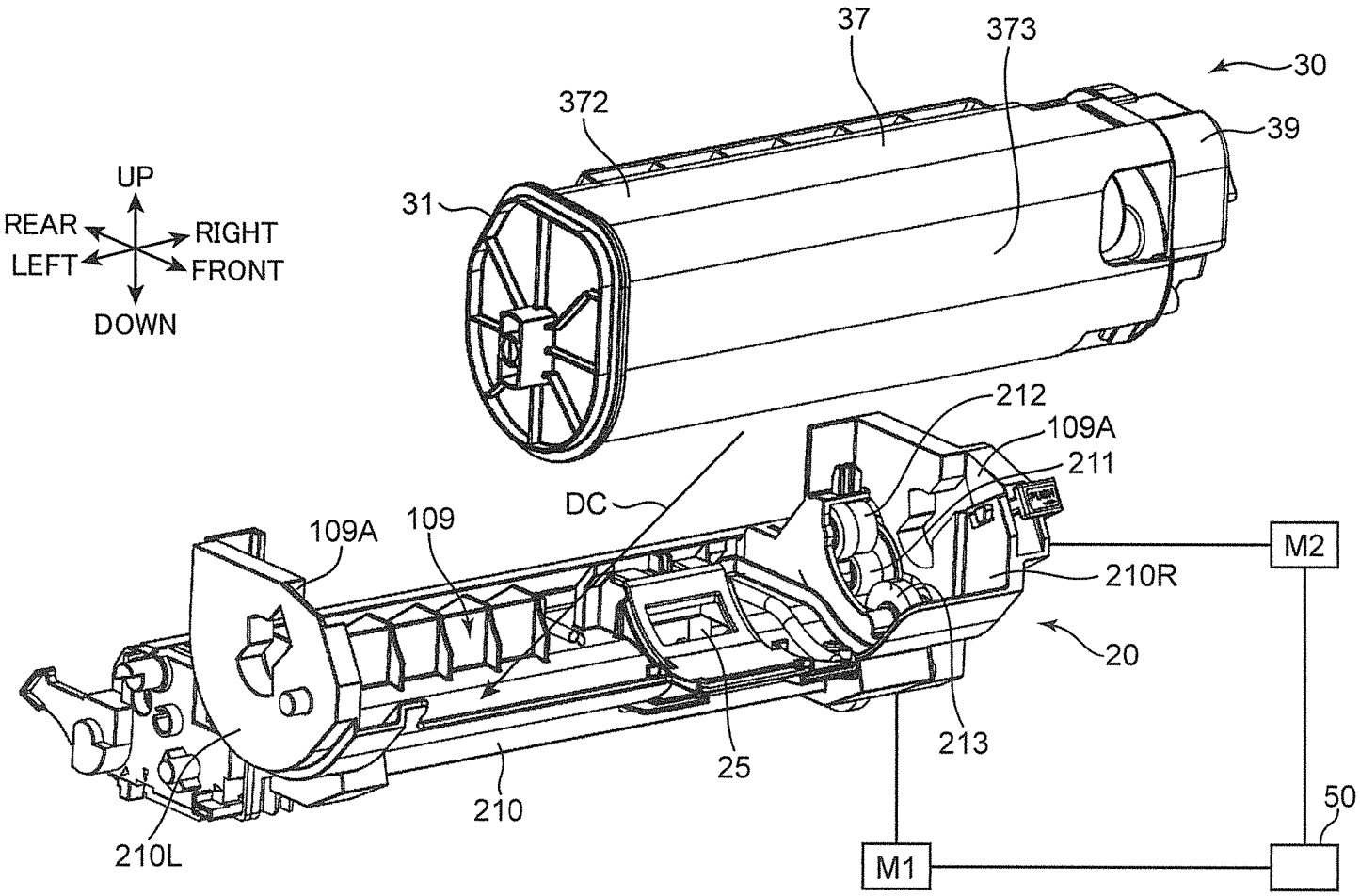
FIG. 7 is a perspective view of the developer housing container and the developing device according to one embodiment of the present disclosure.

FIG. 6 and FIG. 7 are perspective views of the toner container 30 and the developing device 20 according to the present embodiment. The toner container 30 is attachable and detachable to/from the developing device 20 in the casing 101. With reference to FIG. 2, when the opening/closing cover 100C of the casing 101 is opened upward, a container housing portion 109 provided in the developing housing 210 of the developing device 20 is exposed to the outside of the casing 101. With reference to FIG. 6 and FIG. 7, the developing housing 210 includes a pair of a housing left wall 210L and a housing right wall 210R. The container housing portion 109 is formed between the housing left wall 210L and the housing right wall 210R. In the present embodiment, the toner container 30 is attached to the container housing portion 109 generally from above (see an arrow DC in FIG. 6 and FIG. 7). On this occasion, a cover 39 (to be described later) of the toner container 30 is arranged on the housing right wall 210R side, and a lid 31 (to be described later) of the toner container 30 is arranged on the housing left wall 210L side. The developing housing 210 includes a pair of guide grooves 109A (FIG. 7). The guide grooves 109A are groove portions formed in the housing left wall 210L and the housing right wall 210R.

Further with reference to FIG. 7, the developing device 20 includes a first transmission gear 211, a second transmission gear 212, and a third transmission gear 213. The printer 100 includes a first motor M1, a second motor M2, and a control unit 50 which are provided in the casing 101. The first transmission gear 211, the second transmission gear 212, and the third transmission gear 213 are gears rotatably supported on the housing right wall 210R. The first transmission gear 211 is connected to the second transmission gear 212. The first transmission gear 211 is also connected to the developing roller 21, the first stirring screw 23, and the second stirring screw 24 via a group of gears (not shown). When the developing device 20 is attached to the casing 101, the first motor M1 is connected to the third transmission gear 213, and the second motor M2 is connected to the first transmission gear 211.

The first motor M1 causes a moving wall 32 (to be described later) of the toner container 30 to move by causing a shaft 33 (to be described later) of the toner container 30 to rotate via the third transmission gear 213. The second motor M2 causes the developing roller 21, the first stirring screw 23, and the second stirring screw 24 of the developing device 20 to rotate via the first transmission gear 211. Further, the second motor M2 causes a stirring member 35 (to be described later) of the toner container 30 to rotate via the first transmission gear 211 and the second transmission gear 212. The control unit 50 controls the first motor M1 and the second motor M2 to drive each member of the developing device 20 and the toner container 30 in printing operation of the printer 100, or the like.

<Regarding Structure of Toner Container>

Figures 8A, 8B:
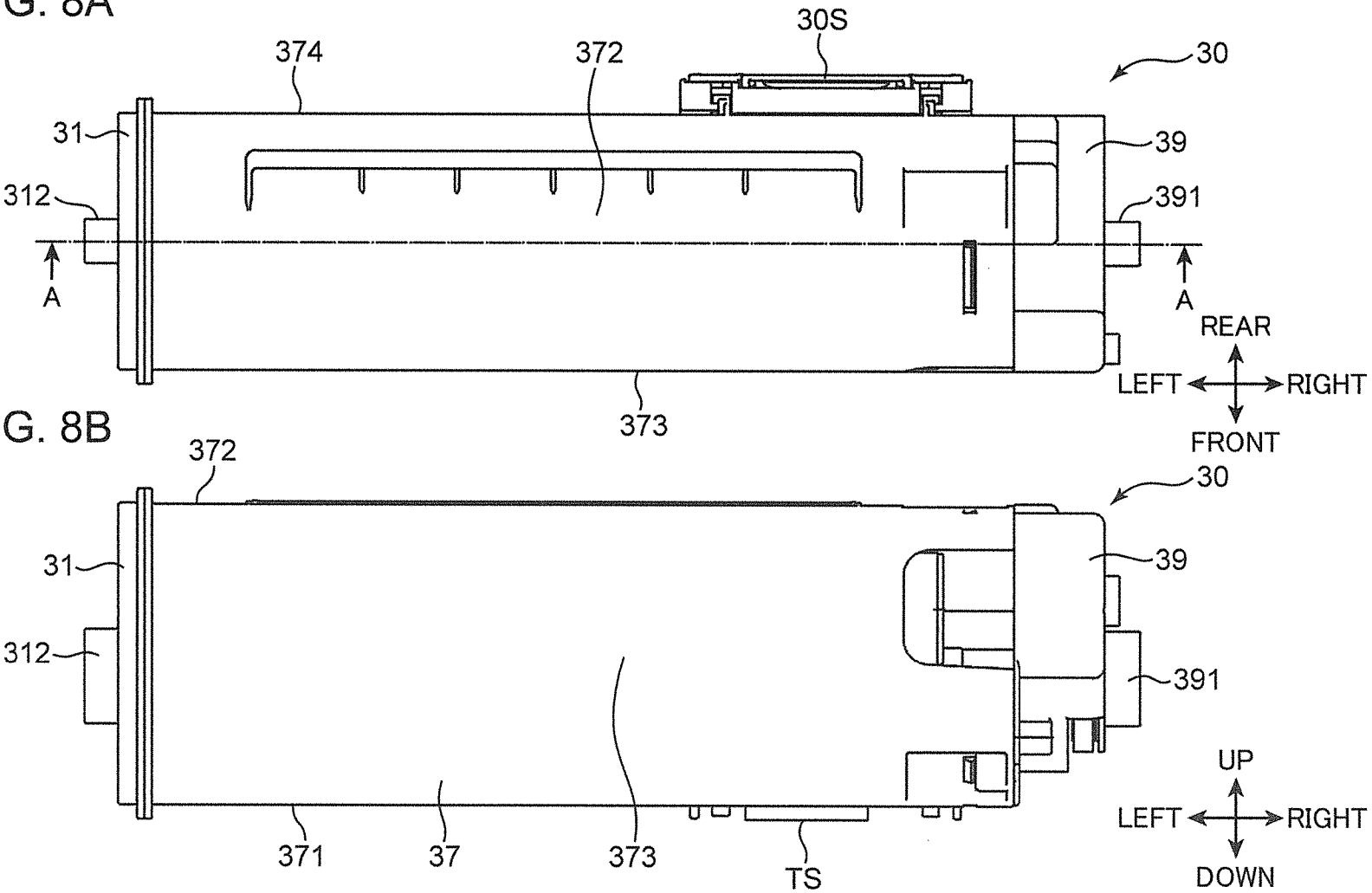
FIG. 8A is a plan view of the developer housing container according to one embodiment of the present disclosure.
FIG. 8B is a front view of the same.
Figure 9:
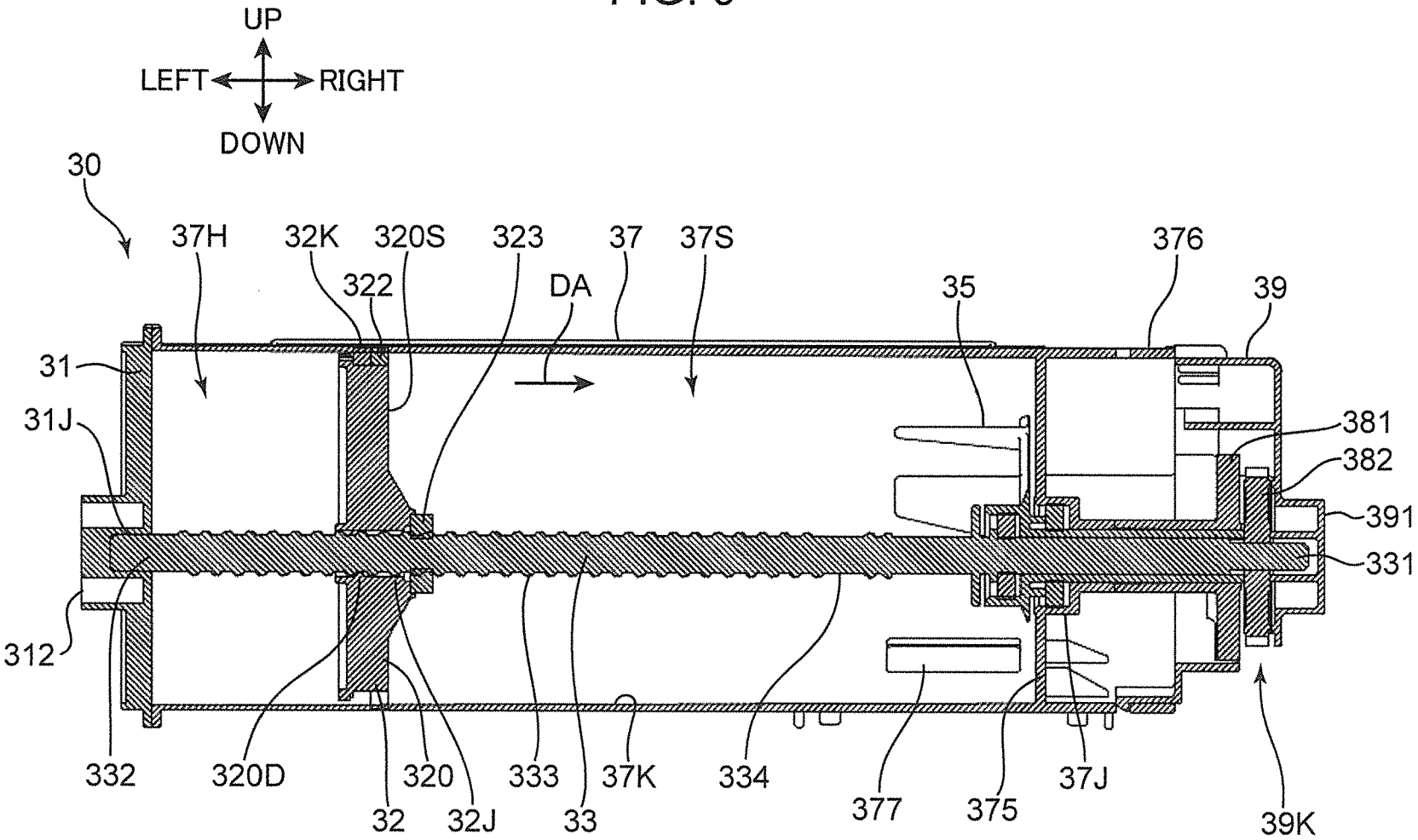
FIG. 9 is a sectional view of the developer housing container according to one embodiment of the present disclosure.
Figure 10:
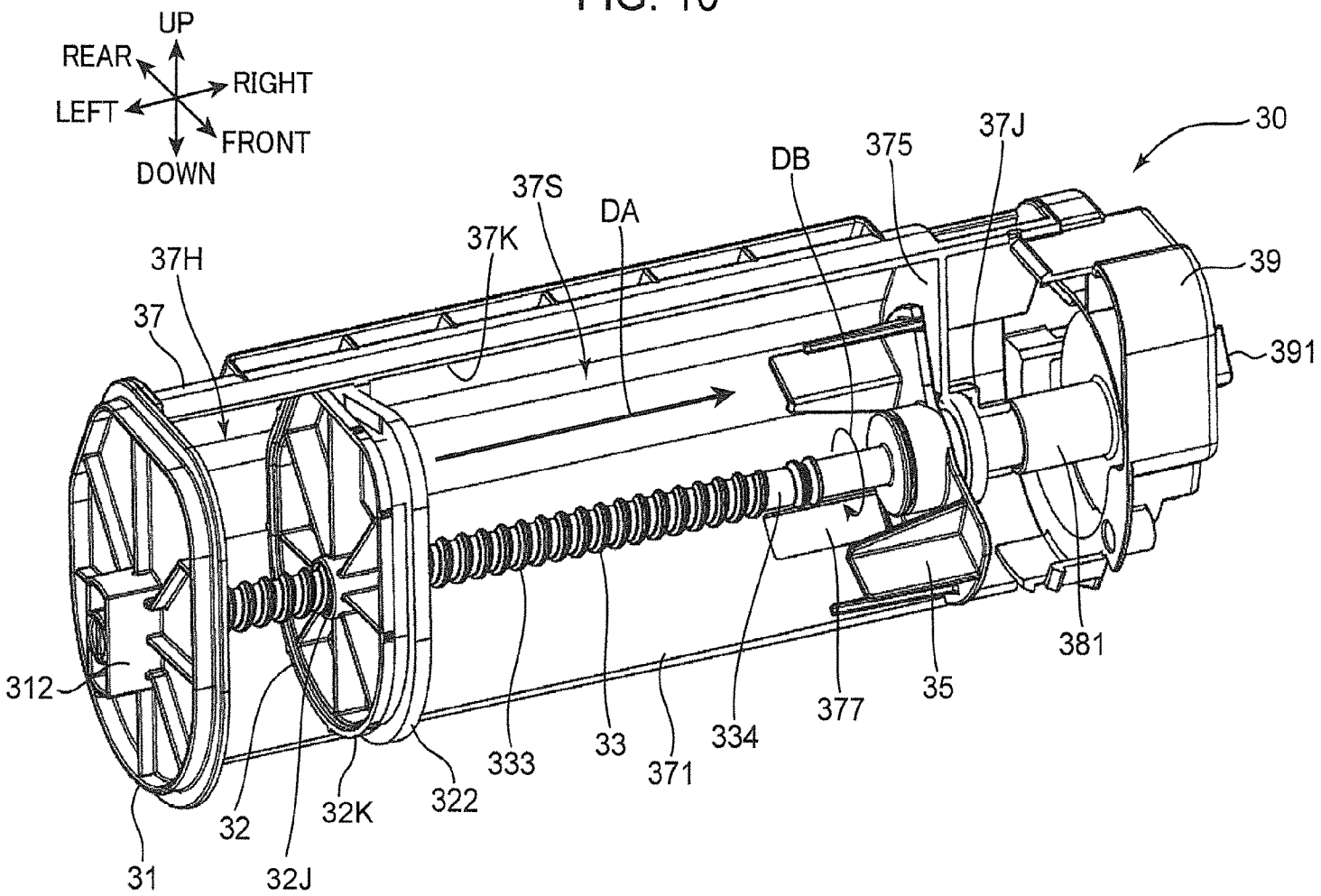
FIG. 10 is a perspective view showing an inside state of the developer housing container according to one embodiment of the present disclosure.
Figure 11:
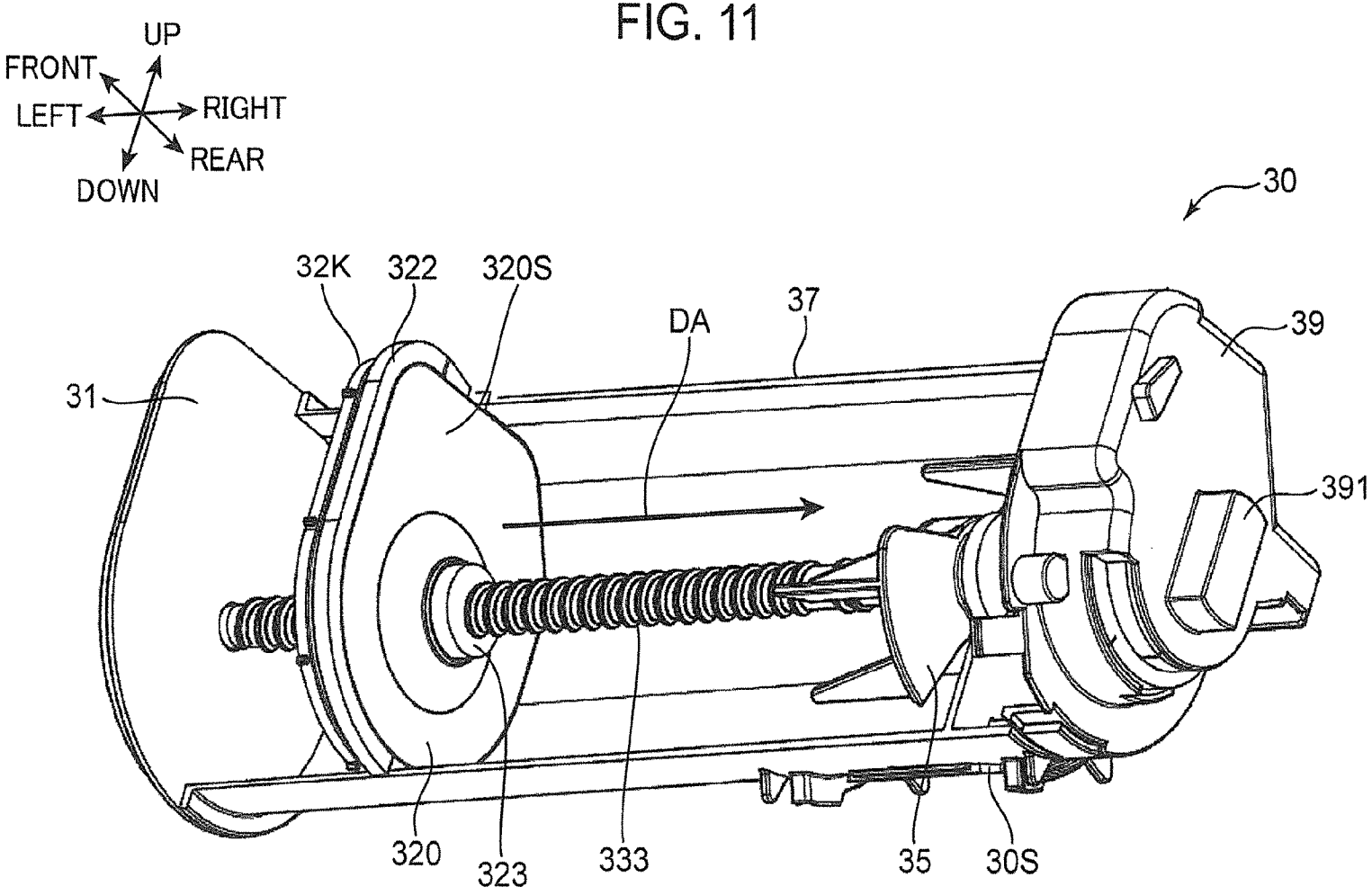
FIG. 11 is a perspective view showing the inside state of the developer housing container according to one embodiment of the present disclosure.

Next, with reference to FIG. 8A to FIG. 11, the toner container 30 (the developer housing container) according to one embodiment of the present disclosure will be described. FIG. 8A is a plan view of the toner container 30 according to the present embodiment, and FIG. 8B is a front view of the toner container. FIG. 9 is a sectional view of the toner container 30. FIG. 10 and FIG. 11 are perspective views showing an inside state of the toner container 30 according to the present embodiment. FIG. 10 and FIG. 11 are perspective views showing a partly missing container main body 37 (to be described later) of the toner container 30.

The toner container 30 has a tubular-shape extending in the right and left direction (a first direction, an arrow DA direction in FIG. 9). The toner container 30 houses therein a replenishing toner (a developer). The toner container 30 includes the lid 31, the moving wall 32, the shaft 33, the stirring member 35, the container main body 37 (the container main body), a toner sensor TS (FIG. 8B), a first gear 381 (FIG. 9), a second gear 382, and the cover 39.

The lid 31 (FIG. 9 and FIG. 10) is fixed to the container main body 37 to seal an opening portion of the container main body 37. The lid 31 includes a lid shaft hole portion 31J and a first guide portion 312 (FIG. 9 and FIG. 11). The lid shaft hole portion 31J is provided in a center part of the lid 31 to pivotally support the shaft 33. The first guide portion 312 is a protrusion formed on a side surface on the left side of the lid 31 (an outer face portion) so as to extend in the up-down direction. The first guide portion 312 includes a function of guiding the toner container 30 to be attached to the developing device 20.

The container main body 37 is a tubular-shaped main body portion of the toner container 30. The container main body 37 includes an inner circumference surface 37K and an internal space 37H (FIG. 9 and FIG. 10). The inner circumference surface 37K is an inner circumference surface of the container main body 37 and defines the internal space 37H tubularly extending in a longitudinal direction (the first direction, the arrow DA direction in FIG. 9 and FIG. 10) of the toner container 30.

Additionally, with reference to FIG. 8A and FIG. 8B, the container main body 37 includes the bottom portion 371, a top 372, a front wall 373, a rear wall 374, a right wall 375 (FIG. 9), and a protruding wall 376 (FIG. 9). The bottom portion 371 is a bottom part of the container main body 37 and has a semi-tubular shape protruding downward. The front wall 373 and the rear wall 374 are a pair of side walls vertically arranged on a side end of the bottom portion 371 to extend upward. The top 372 is arranged above the bottom portion 371 to cover an upper part of the internal space 37H. The right wall 375 is a wall portion provided continuously with one end side (right end side) of each of the bottom portion 371, the front wall 373, the rear wall 374, and the top 372 in the first direction to block the container main body 37. The internal space 37H is a space defined by the inner circumference surface 37K formed by the bottom portion 371, the top 372, the front wall 373, and the rear wall 374, and further by the right wall 375 and the lid 31. In the internal space 37H, a region between the right wall 375 and the moving wall 32 is a housing space 37S. The housing space 37S is a space in which a toner is housed inside the toner container 30.

As shown in FIG. 9, in the container main body 37, the side opposite to the right wall 375 in the first direction is opened (an opening portion). When the lid 31 is fixed to the opening portion, the lid 31 blocks the internal space 37H of the container main body 37. An outer circumference edge of the lid 31 is ultrasonically welded to the container main body 37.

With reference to FIG. 9, the protruding wall 376 is a part of an outer circumference surface of the container main body 37, the part protruding more to the right side than the right wall 375. The cover 39 is attached to the protruding wall 376.

The container main body 37 includes the above-described toner discharge port 377 (the developer discharge port), a shutter 30S (FIG. 6 and FIG. 8A), and a main body bearing portion 37J (FIG. 9). The toner discharge port 377 communicates with the inner circumference surface 37K so as to be opened in a lower face portion of the container main body 37. As shown in FIG. 9, the toner discharge port 377 is opened in the lower face portion of a right end portion (one end portion in the first direction) of the container main body 37 so as to communicate with the internal space 37H. In other words, the toner discharge port 377 is arranged adjacent to the right wall 375 in the first direction. The toner discharge port 377 is also opened to have a rectangular shape with a predetermined length along the first direction and with a predetermined width along a circular arc-shape of the bottom portion 371. In the present embodiment, the toner discharge port 377 is opened along the circumference direction at a position closer to the rear side and deviated upward with respect to a lower end portion of the bottom portion 371. The toner discharge port 377 allows a toner to be discharged from the housing space 37S toward the developing device 20.

In the present embodiment, as described above, the bottom portion 371, the front wall 373, the rear wall 374, and the top 372 form the internal space 37H of the container main body 37. As a result, a toner in the housing space 37S gathers in the bottom portion 371 having a circular arc shape due to self-weight of the toner, so that a toner to be transported by the moving wall 32 (to be described later) can be efficiently discharged from the toner discharge port 377.

The shutter 30S (FIG. 6) is slidably arranged in the right end portion of the container main body 37. The shutter 30S blocks (seals) the toner discharge port 377 from the outside of the container main body 37, as well as exposing the toner discharge port 377 to the outside. Sliding movement of the shutter 30S is conducted in association with attaching operation of the toner container 30 to the developing device 20.

The main body bearing portion 37J is a bearing formed on the right wall 375. The shaft 33 is inserted into the main body bearing portion 37J. On this occasion, a right end side of the shaft 33 protrudes to the outside of the container main body 37.

The moving wall 32 is a wall portion arranged facing the first direction inside the container main body 37 (the internal space 37H). The moving wall 32 defines one end face (left end face) of the housing space 37S in the first direction. The other end face (right end face) of the housing space 37S in the first direction is defined by the right wall 375. The moving wall 32 also has a function of moving in the first direction inside the internal space 37H from an initial position on the one end side in the first direction to a final position on the other end side while transporting a toner in the housing space 37S toward the toner discharge port 377 during a period from the start of use of the toner container 30 to the end of the use. In the present embodiment, the initial position of the moving wall 32 is located on the right side of the lid 31 (a downstream side in the first direction) and the final position is located on an immediate left side of the toner discharge port 377 (an upstream side in the first direction).

With reference to FIG. 9 to FIG. 11, the moving wall 32 includes a transport wall portion 320, an inner wall seal 322, a shaft seal 323, a bearing portion 32J (FIG. 9), and an outer circumference surface 32K. The outer circumference surface 32K is arranged to be opposed to the inner circumference surface 37K of the container main body 37.

The transport wall portion 320 is a wall portion defining the housing space 37S together with the inner circumference surface 37K of the container main body 37. In particular, the transport wall portion 320 includes a transport surface 320S perpendicular to the shaft 33. The transport surface 320S transports a toner in the housing space 37S while pressing the toner along with movement of the moving wall 32. The transport surface 320S defines the housing space 37S together with the inner circumference surface 37K of the container main body 37, the housing space 37S housing a toner.

The main body bearing portion 32J is a bearing portion formed in a generally central part of the transport wall portion 320. The main body bearing portion 32J moves along the first direction while holding the moving wall 32. The shaft 33 (to be described later) is inserted into the main body bearing portion 32J.

The main body bearing portion 32J includes a female spiral portion 320D. The female spiral portion 320D is a spiral screw portion formed in an inner circumference surface of the main body bearing portion 32J. The female spiral portion 320D has a function of moving the moving wall 32 along the first direction by engagement with a male spiral portion 333 (to be described later) of the shaft 33.

The inner wall seal 322 is a sealing member arranged on the downstream side of the moving wall 32 in the first direction and along the outer circumference surface 32K of the moving wall 32. The inner wall seal 322 is arranged on the moving wall 32 over the entire circumference direction. The inner wall seal 322 is an elastic member made of a urethane sponge.

The inner wall seal 322 is compressively deformed between the inner circumference surface 37K of the container main body 37 and the moving wall 32. The inner wall seal 322 prevents a toner in the housing space 37S from flowing out from between the inner circumference surface 37K of the container main body 37 and the moving wall 32 to an upstream side of the moving wall 32 in a moving direction.

The shaft seal 323 is fixed, to the main body bearing portion 32J, at a position closer to a front end side of the moving wall 32 in the moving direction than to the female spiral portion 320D (FIG. 9). Because the shaft seal 323 has a ring shape, the shaft seal 323 is closely attached to the shaft 33 over the entire circumference direction of the shaft 33. This prevents a toner in the housing space 37S from passing through the main body bearing portion 32J to flow out to an upstream side of the moving wall 32 in the moving direction.

The shaft 33 is rotatably supported by the right wall 375 of the container main body 37 and the lid 31 so as to extend in the first direction in the internal space 37H. The shaft 33 includes a first shaft end portion 331, a second shaft end portion 332, the male spiral portion 333, and a moving wall stop portion 334.

With reference to FIG. 9, the first shaft end portion 331 is a front end portion of the shaft 33 passing through the main body bearing portion 37J to protrude to the right side. On a circumference surface of the first shaft end portion 331, a pair of D surfaces is formed. The second gear 382 having a D-hole shape at a center part thereof is engaged with the first shaft end portion 331. As a result, the shaft 33 and the second gear 382 are integrally rotatable. The second shaft end portion 332 is a left end portion of the shaft 33. The second shaft end portion 332 is pivotally supported by the lid shaft hole portion 31J formed in the lid 31.

The male spiral portion 333 is a spiral screw portion formed on an outer circumference surface of the shaft 33 in the internal space 37H. In the present embodiment, of the shaft 33, the male spiral portion 333 is arranged from a region adjacent to the lid 31 to a region upstream of the toner discharge port 377 in the first direction (the arrow DA in FIG. 10) as shown in FIG. 10.

The moving wall stop portion 334 is arranged continuously with the downstream side of the male spiral portion 333 in the first direction. The moving wall stop portion 334 is a region only formed of a shaft part, from which region, the male spiral portion 333 is partly missing from the shaft 33 in the internal space 37H. The moving wall stop portion 334 is positioned above the toner discharge port 377 and upstream of the toner discharge port 377 in the first direction.

The stirring member 35 (FIG. 9) is arranged above the toner discharge port 377 so as to be along the right wall 375. The stirring member 35 stirs a toner in the housing space 37S, while sending the toner from the toner discharge port 377. In the present embodiment, the stirring member 35 rotates around the shaft 33 and relative to the shaft 33. In FIG. 10, the stirring member 35 is rotated in an arrow DB direction.

The first gear 381 transmits a rotation driving force to the stirring member 35. The first gear 381 is connected to the second motor M2 via the first transmission gear 211 and the second transmission gear 212 of the developing device 20 (FIG. 7). In the present embodiment, the first gear 381 is driven to rotate in synchronization with the developing roller 21, the first stirring screw 23, and the second stirring screw 24 of the developing device 20. The first gear 381 is connected to the stirring member 35 passing through the main body bearing portion 37J. As a result, the first gear 381 and the stirring member 35 integrally rotate.

The second gear 382 transmits a rotation driving force to the shaft 33. The second gear 382 is connected to the first motor M1 via the third transmission gear 213 (FIG. 7). As shown in FIG. 9, the right end portion of the shaft 33 is arranged to pass through the stirring member 35. Then, the second gear 382 is connected (fixed) to a front end portion (the first shaft end portion 331) of the shaft 33.

The cover 39 is attached to the protruding wall 376 of the container main body 37. The cover 39 has a function of exposing parts of the first gear 381 and the second gear 382 in circumference directions thereof, and covering the remaining parts of the first gear 381 and the second gear 382 in the circumference directions. With reference to FIG. 9, the cover 39 includes a second guide portion 391 and an opening portion for gear 39K.

The second guide portion 391 is a protrusion provided to protrude rightward from a side face on the right side of the cover 39 along the up-down direction. The second guide portion 391 has a function of guiding, together with the first guide portion 312 of the lid 31, the toner container 30 to be attached to the developing device 20.

The opening portion for gear 39K is an opening portion which is obtained by opening a lower face portion of the cover 39 so as to have a semi-circular arc shape. When the cover 39 is attached to the container main body 37, parts of the first gear 381 and the second gear 382 are exposed to the outside of the toner container 30 via the opening portion for gear 39K. As a result, upon attachment of the toner container 30 to the developing housing 210 of the developing device 20, the first gear 381 and the second gear 382 are engaged with an electromagnetic clutch connected to the second transmission gear 212, and the third transmission gear 213 (FIG. 7), respectively.

The toner sensor TS (FIG. 8B) is a sensor fixed to the container main body 37. The toner sensor TS is arranged above the toner discharge port 377 so as to be adjacent thereto in a circumference direction. The toner sensor TS is a sensor formed by a magnetic permeability sensor (magnetic sensor) or a piezoelectric element. When the toner sensor TS is formed by a piezoelectric element, a sensor part of the toner sensor TS is exposed to the housing space 37S. The toner sensor TS outputs a HIGH signal (+5 V) upon pressing by a toner in the housing space 37S. When a toner is barely present above the toner sensor TS, the toner sensor TS outputs a LOW signal (0 V). An output signal of the toner sensor TS is referred to by the control unit 50 (FIG. 7). When the toner sensor TS is a magnetic permeability sensor, the sensor does not need to directly come into contact with the toner. Therefore, the toner sensor TS only needs to be fixed to an outer wall of the container main body 37. In another embodiment, the toner sensor TS may be arranged on the developing housing 210 side (the device main body side) of the developing device 20 so as to be opposed to the outer wall of the container main body 37. Further, the toner sensor TS is not limitedly arranged on the rear wall 374. In another embodiment, the toner sensor may be arranged on the top 372, the front wall 373, or the bottom portion 371 of the container main body 37, or the like.

<Regarding Movement of Moving Wall>

The toner container 30 is attached to the container housing portion 109 by a user while the first guide portion 312 of the lid 31 and the second guide portion 391 of the cover 39 are guided by the pair of guide grooves 109A of the developing device 20 (FIG. 6 and FIG. 7). Upon attachment of the toner container 30 to the container housing portion 109, the shutter 30S is moved to release the toner discharge port 377. As a result, the toner discharge port 377 is arranged above and so as to be opposed to the toner replenishing port 25 (FIG. 4 and FIG. 5).

FIG. 10 is a sectional view showing an intermediate state of the moving wall 32 moving from the initial position in the first direction. The initial position of the moving wall 32 is set at a position along the lid 31, i.e., on the left side of the position of the moving wall 32 shown in FIG. 9.

When a new toner container 30 is attached to the printer 100, the control unit 50 (FIG. 7) causes the first motor M1 to drive the shaft 33 so as to rotate via the second gear 382 which engages with the third transmission gear 213. As a result, engagement of the male spiral portion 333 of the shaft 33 with the female spiral portion 320D of the moving wall 32 causes the moving wall 32 to move toward the toner discharge port 377 in the first direction (the arrow DA in FIG. 9), so that a toner in the housing space 37S is discharged from the toner discharge port 377. After a while, when the moving wall 32 moves rightward from the initial position by a predetermined distance, the housing space 37S is filled with a toner, so that the toner sensor TS outputs a HIGH signal corresponding to a fill-up state. Upon receiving the HIGH signal output from the toner sensor TS, the control unit 50 causes the moving wall 32 to stop.

As described above, the present embodiment adopts a volume replenishment type toner replenishing system as shown in FIG. 5. Therefore, when the retention part 29 on the developing device 20 side (FIG. 5) seals the toner replenishing port 25 from below, no replenishing toner will fall down from the toner container 30. On the other hand, when a toner is supplied to the photosensitive drum 121 from the developing roller 21 of the developing device 20 to reduce a toner in the retention part 29, the toner flows into the developing device 20 from the toner discharge port 377 via the toner replenishing port 25. As a result, since the toner around the toner sensor TS is lost in the housing space 37S of the toner container 30, the toner sensor TS outputs a LOW signal. Upon receiving the signal, the control unit 50 drives the first motor M1 until the toner sensor TS outputs the HIGH signal, thereby further moving the moving wall 32 toward the toner discharge port 377.

In response to developing operation in the developing device 20, the control unit 50 drives the second motor M2 to cause the developing roller 21 and the like to rotate. In association with the rotation operation, the stirring member 35 is rotated via the first gear 381 engaged with the second transmission gear 212. As a result, because the stirring member 35 arranged on a right end side of the housing space 37S rotates around the shaft 33, a toner above the toner discharge port 377 is stably stirred. This increases fluidity of the toner, so that the toner stably falls down from the toner discharge port 377.

When printing operation is repeated and the toner in the housing space 37S of the toner container 30 is continuously used, the moving wall 32 leads to the final position before the toner discharge port 377 after a while. In this manner, gradual movement of the moving wall 32 in the first direction causes the toner in the housing space 37S to be transported until reaching the toner discharge port 377 while being pressed by the moving wall 32. On this occasion, the housing space 37S is gradually reduced during a period until the moving wall 32 reaches the final position. Accordingly, a space itself in which a toner remains is gradually lost in the toner container 30. As a result, as compared with a conventional toner container in which a capacity of a housing space does not change, an amount of a toner remaining in the housing space 37S of the container main body 37 is reduced at the end of use.

In the present embodiment, the moving wall 32 stops at the final position slightly upstream of the toner discharge port 377 in the first direction. In detail, when the main body bearing portion 32J of the moving wall 32 reaches the moving wall stop portion 334 along with the movement of the moving wall 32, engagement of the male spiral portion 333 and the female spiral portion 320D is released. As a result, transmission of a moving force from the shaft 33 to the moving wall 32 is lost, so that the moving wall 32 stops at the final position.

<Regarding Communicating Mechanism>

Figure 12:
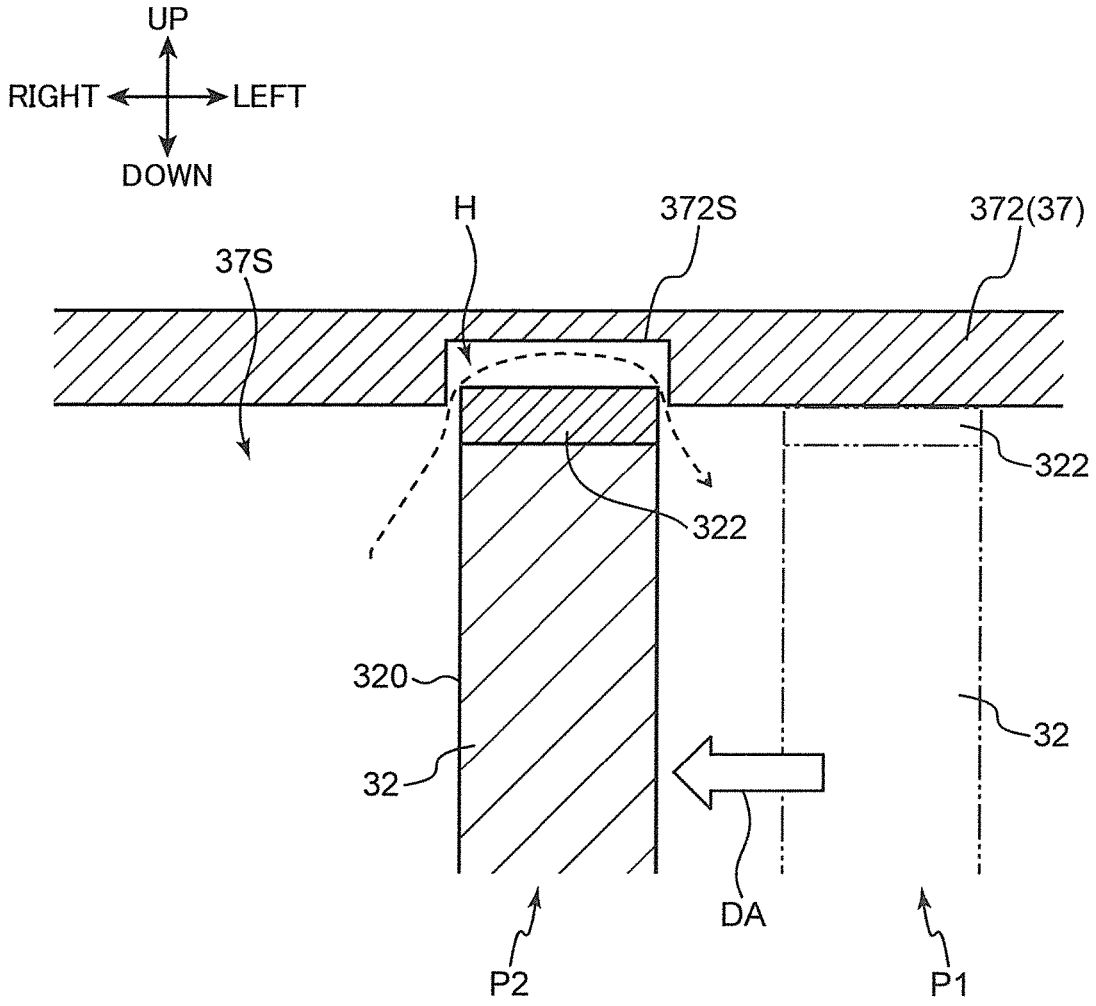
FIG. 12 is a schematic enlarged sectional view of the developer housing container according to one embodiment of the present disclosure.
Figure 13:
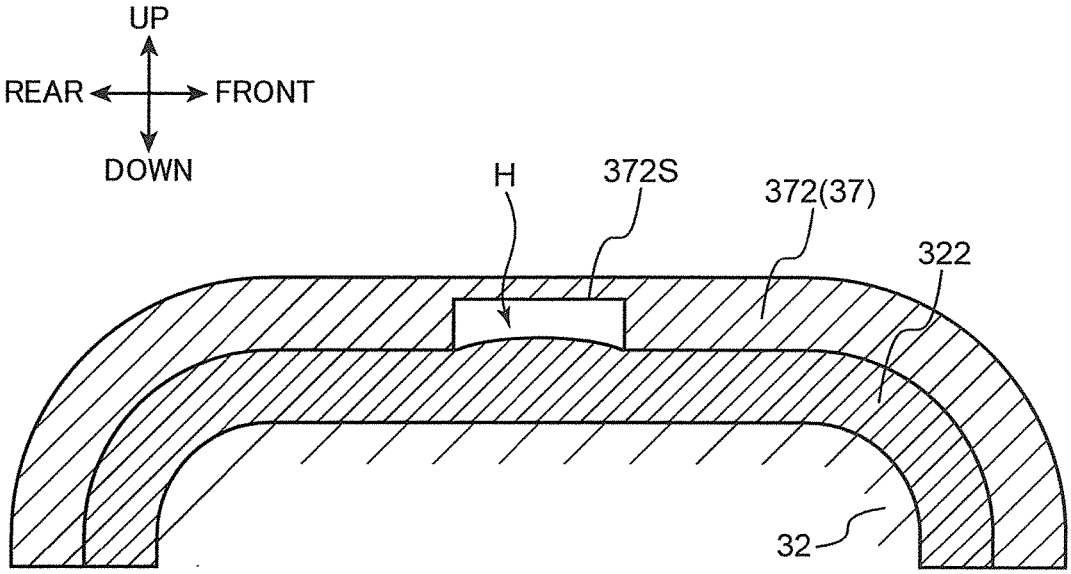
FIG. 13 is a schematic enlarged sectional view of the developer housing container according to one embodiment of the present disclosure.

FIG. 12 and FIG. 13 are schematic enlarged sectional views of the toner container 30 according to the present embodiment. FIG. 12 is a sectional view of the moving wall 32 and the top 372 of the container main body 37 seen along a horizontal direction orthogonal to the moving direction (the first direction, the arrow DA) of the moving wall 32. FIG. 13 is a sectional view of the moving wall 32 and the top 372 of the container main body 37 seen along the moving direction (the first direction, the arrow DA) of the moving wall 32.

With reference to FIG. 12 and FIG. 13, the container main body 37 according to the present embodiment includes a plurality of recessed portions 372S (a communicating mechanism). The plurality of recessed portions 372S are each arranged at an interval from each other in the first direction. FIG. 12 illustrates one recessed portion 372S among the plurality of recessed portions 372S. The plurality of recessed portions 372S are each arranged at a predetermined position of the container main body 37 in the first direction, and partly releasing compression of the inner wall seal 322 (deforming the inner wall seal 322) causes the housing space 37S and the internal space 37H upstream of the moving wall 32 in the first direction to communicate with each other.

As shown in FIG. 12 and FIG. 13, the recessed portions 372S are formed in the inner circumference surface 37K of the container main body 37. In particular, in the present embodiment, the recessed portions 372S are formed in the inner circumference surface 37K of the top 372 in the container main body 37. As shown in FIG. 12, the recessed portions 372S are arranged such that a thickness of the container main body 37 is partly small, i.e., an internal diameter of the container main body 37 is partly increased. Also as shown in FIG. 13, the recessed portions 372S are partly formed in a center part of the top 372 in a front-rear direction (a horizontal direction orthogonal to the first direction). Also as shown in FIG. 12, a width of the recessed portion 372S in the first direction is set to be larger than a width of the inner wall seal 322 in the first direction.

Although in FIG. 12, a part of the container main body 37, the part in which the recessed portion 372S is not formed in the first direction, is defined as a waiting position P1. A part of the container main body 37, the part in which the recessed portion 372S is formed in the first direction, is defined as a communication position P2. When the first motor M1 is driven to rotate by the control unit 50 (FIG. 7), the moving wall 32 moves in the first direction (the arrow DA in FIG. 12). Then, when the moving wall 32 reaches a position (the communication position P2) opposed to the recessed portion 372S, the compressed part of the inner wall seal 322 is partly released upward (FIG. 13). Then, the housing space 37S and the internal space 37H upstream of the moving wall 32 in the first direction communicate with each other through the recessed portion 372S (a vent path H in FIG. 12 and FIG. 13). As a result, air in the housing space 37S with an internal pressure increased by movement of the moving wall 32 flows into a space upstream of the moving wall 32 via the recessed portion 372S (broken line arrow in FIG. 12). Accordingly, the internal pressures of the air in the spaces upstream and downstream of the moving wall 32 are uniformed. This prevents a toner from being blown off from around the inner wall seal 322, the shaft seal 323, and the toner discharge port 377 due to a difference in an internal pressure between spaces upstream and downstream of the moving wall 32.

In this manner, in the present embodiment, fitting-in of a part of the inner wall seal 322 into the recessed portion 372S releases compression of the inner wall seal 322. Then, the recessed portion 372S functions as a vent path to realize mitigation of an internal pressure difference. As a result, a simple configuration of the container main body 37 enables suppression of blowing-off of a toner due to an internal pressure difference. A toner disposed in the housing space 37S accumulates in a lower part of the container main body 37 due to function of gravity. Accordingly, formation of the recessed portion 372S in the top 372 suppresses a toner from leaking from the surroundings of the recessed portion 372S. As a result, images can be stably formed on the sheet S while suppressing pollution in the printer 100.

Also in the present embodiment, the plurality of recessed portions 372S is provided along the first direction. Therefore, internal pressures of the spaces upstream and downstream of the moving wall 32 are stabilized a plurality of times to be uniform during a course of moving of the moving wall 32.

In one movement control, the control unit 50 preferably controls the first motor M1 such that the moving wall 32 passes the communication position P2 opposed to the recessed portion 372S and the moving wall 32 stops at the waiting position P1 downstream of the recessed portion 372S in the first direction. In this case, since the moving wall 32 does not stop at the communication position P2 for a long time, the toner container 30 will not be taken off while being used, with the moving wall 32 being at the communication position P2, so that sealing properties in the toner container 30 are suppressed from being damaged. In other words, the control unit 50 preferably controls the first motor M1 such that the moving wall 32 is arranged at the waiting position P1 when the moving wall 32 does not move.

Additionally, as described above, the present embodiment adopts volume replenishment type toner replenishment. Specifically, a toner in the housing space 37S applies pressure to a toner around the toner replenishing port 25 to execute operation of replenishing a toner from the toner container 30 to the developing device 20. Then, since the function of the recessed portions 372S suppresses an excessive increase of an internal pressure of the housing space 37S, inflow of an excessive replenishing toner into the developing housing 210 of the developing device 20 is suppressed.

In the foregoing, the description has been made of the printer 100 including the toner container 30 according to the embodiment of the present disclosure. On the other hand, the present disclosure is not limited thereto and such a modified embodiment as shown below can be adopted.

(1) Although in the above embodiment, the description has been made of a monochrome printer as the printer 100, the present disclosure is not limited thereto. In particular, when the printer 100 is a tandem type color printer, after the opening/closing cover 100C (FIG. 2) of the printer 100 is opened, the toner containers 30 corresponding to toners of a plurality of colors may be attached into the casing 101 from above so as to be adjacent to each other.

(2) Additionally, although in the above embodiment, the description has been made of a mode in which the moving wall 32 moves from the lid 31 side to the right wall 375 side, the present disclosure is not limited thereto. The toner discharge port 377 may be opened on the lid 31 side and the moving wall 32 may move from the right wall 375 side to the lid 31 side. Further, an opening position of the toner discharge port 377 is not limited to the above position. The toner discharge port 377 may be opened in the lowermost end portion of the bottom portion 371 or may be opened at another position.

(3) Additionally, although in the above embodiment, the description has been made of a volume replenishment type toner replenishing system, the present disclosure is not limited thereto. The developing housing 210 of the developing device 20 may also include a toner sensor (not shown) such that the moving wall 32 is moved in response to an output of the toner sensor so that a toner is replenished from the toner container 30 to the developing device 20. The developing device 20 is not limited to a one-component developing system but may adopt a two-component developing system.

Figure 14:
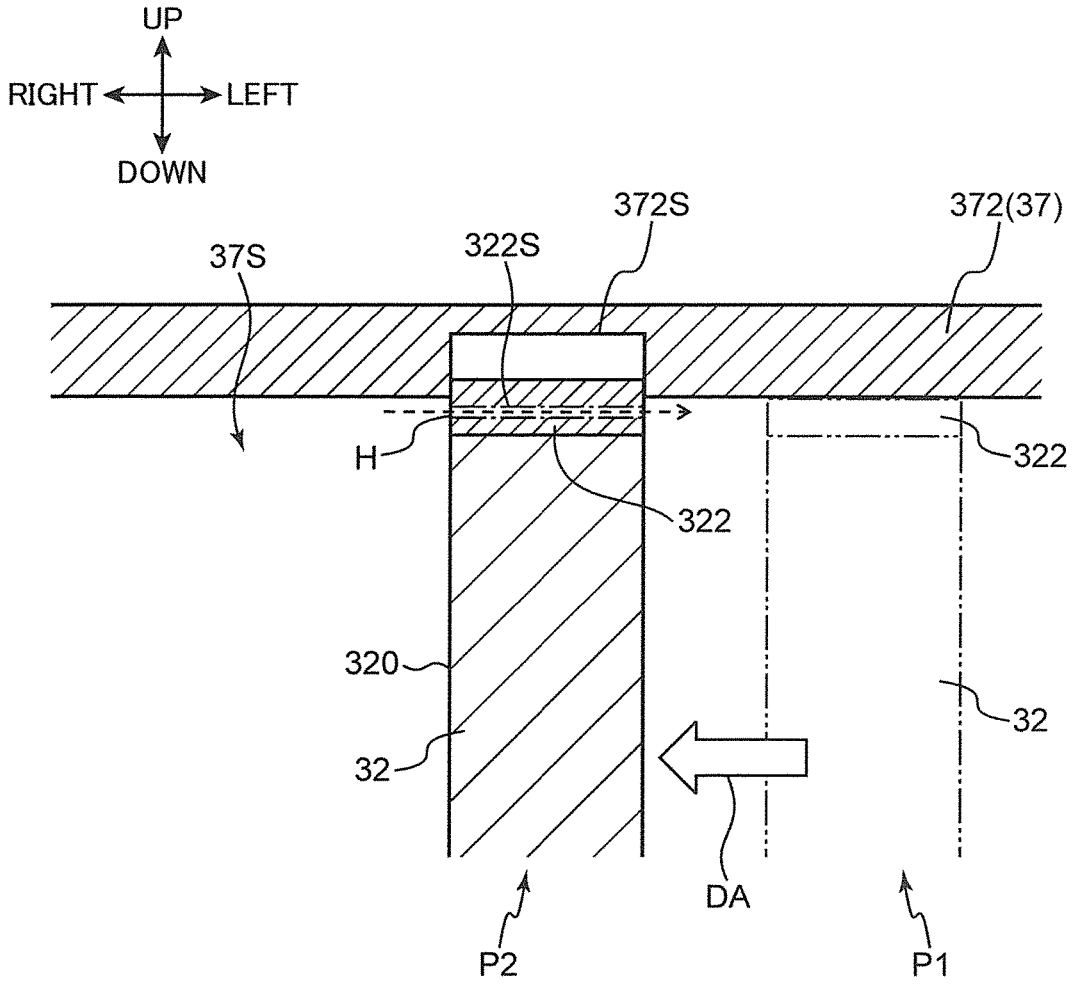
FIG. 14 is a schematic enlarged sectional view of a developer housing container according to a first modified embodiment of the present disclosure.
Figure 15:
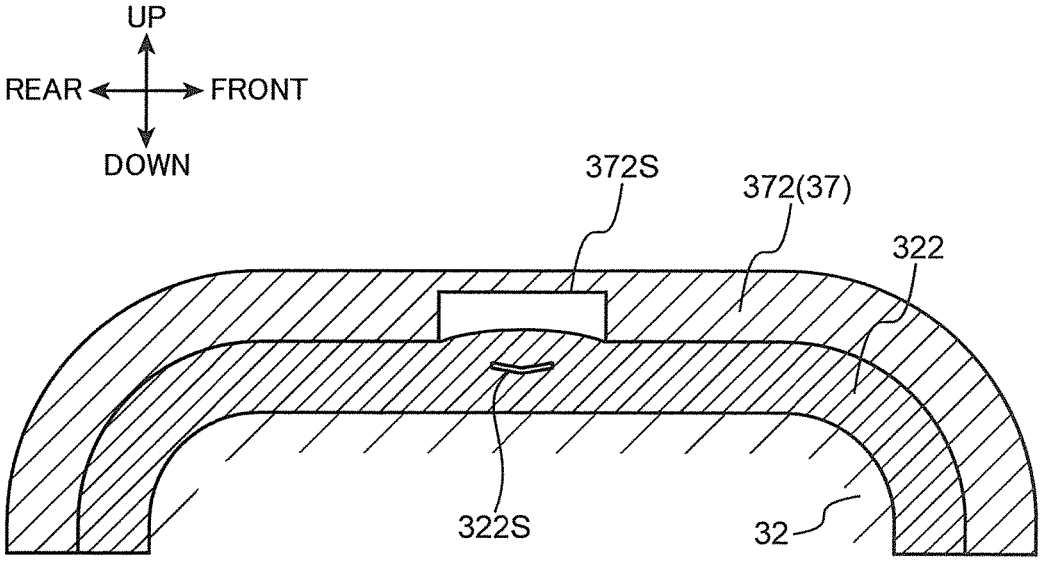
FIG. 15 is a schematic enlarged sectional view of the developer housing container according to the first modified embodiment of the present disclosure.

(4) Although in the above embodiment, the description has been made of a mode in which the recessed portions 372S form the vent path H, the present disclosure is not limited thereto. FIG. 14 and FIG. 15 are schematic enlarged sectional views of a toner container according to a first modified embodiment of the present disclosure. FIG. 14 is a sectional view of the moving wall 32 and the top 372 of the container main body 37 seen along the horizontal direction orthogonal to the moving direction (the first direction, the arrow DA) of the moving wall 32. FIG. 15 is a sectional view of the moving wall 32 and the top 372 of the container main body 37 seen along the moving direction (the first direction, the arrow DA) of the moving wall 32.

In this modified embodiment, a V-shaped notched portion 322S extending along the first direction is formed, in the inner wall seal 322, below the recessed portion 372S as shown in FIG. 15. The notched portion 322S is blocked at the waiting position P1 in FIG. 14 by compression of the inner wall seal 322. On the other hand, when the moving wall 32 reaches the communication position P2 opposed to the recessed portion 372S, release of the compression of the inner wall seal 322 results in opening the notched portion 322S to form the vent path H. As a result, the housing space 37S and the internal space 37H upstream of the moving wall 32 in the first direction communicate with each other via the vent path H. As a result, air in the housing space 37S with an internal pressure increased by movement of the moving wall 32 flows into the space upstream of the moving wall 32 via the recessed portion 372S (broken line arrow in FIG. 14). Accordingly, the internal pressures of the air in the spaces upstream and downstream of the moving wall 32 are uniformed. This prevents a toner from being blown off from around the inner wall seal 322, the shaft seal 323, and the toner discharge port 377 due to a difference in an internal pressure between spaces upstream and downstream of the moving wall 32. Additionally, forming the notched portion 322S in the inner wall seal 322 in advance enables use of a part of the inner wall seal 322 as the vent path H.

Figure 16:
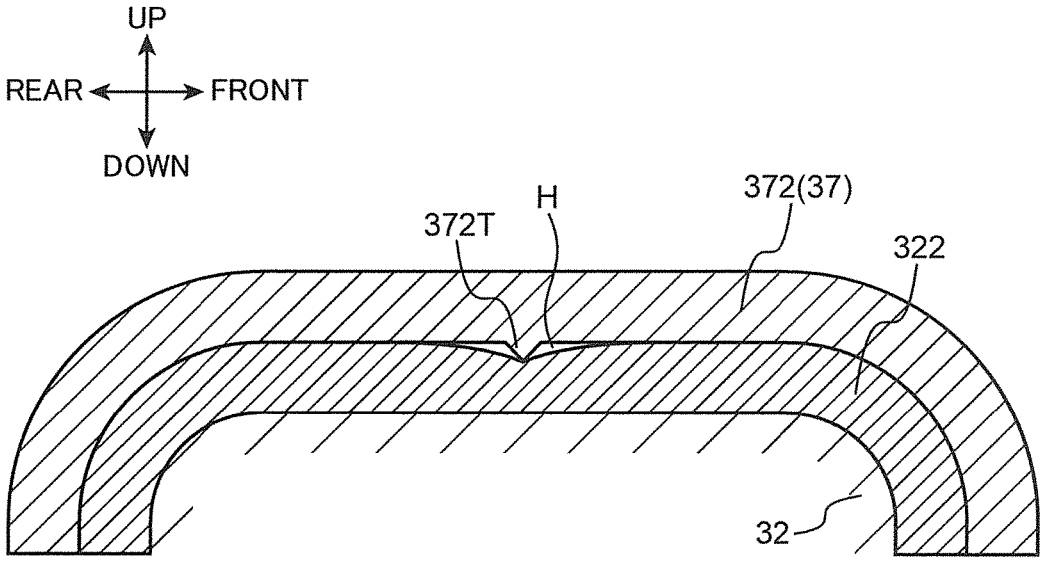
FIG. 16 is a schematic enlarged sectional view of a developer housing container according to a second modified embodiment of the present disclosure.

(5) FIG. 16 is a schematic enlarged sectional view of a toner container according to a second modified embodiment of the present disclosure. In this modified embodiment, a protrusion 372T (a communicating mechanism) is formed on an inner circumference surface of the top 372. The protrusion 372T preferably includes a plurality of protrusions arranged at an interval in the first direction. Also in the present embodiment, the protrusions 372T form the vent path H (FIG. 16) by partly deforming the inner wall seal 322, thereby causing the housing space 37S (see FIG. 12) and the internal space 37H upstream of the moving wall 32 in the first direction to communicate with each other.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A developer housing container comprising:

a container main body having an inner circumference surface which defines an internal space tubularly extending along a first direction, and provided with a developer discharge port which is opened so as to communicate with the internal space and allows a developer to be discharged;

a moving wall which has an outer circumference surface arranged to be opposed to the inner circumference surface of the container main body, and has a transport surface that defines, together with the inner circumference surface of the container main body, a housing space in which the developer is housed, the moving wall moving in the first direction in the internal space while transporting the developer in the housing space toward the developer discharge port;

a sealing member which is arranged over an entire circumference direction of the moving wall along the outer circumference surface of the moving wall, and is compressively deformed between the inner circumference surface of the container main body and the moving wall; and at least one communicating mechanism which is arranged at a predetermined position in the first direction in the container main body and which allows the housing space and the internal space upstream of the moving wall in the first direction to communicate with each other by partly deforming the sealing member.

2. The developer housing container according to claim 1, wherein the at least one communicating mechanism has a plurality of the communicating mechanisms arranged at an interval in the first direction.

3. The developer housing container according to claim 1, wherein the communicating mechanism is a recessed portion formed in the inner circumference surface of the container main body.

4. The developer housing container according to claim 3, wherein the container main body has a top which defines an upper face portion of the internal space, and the recessed portion is formed in the top of the container main body.

5. The developer housing container according to claim 3, wherein a width of the recessed portion in the first direction is set to be larger than a width of the sealing member in the first direction, and when the moving wall reaches a position opposed to the recessed portion, the housing space and the internal space upstream of the moving wall in the first direction communicate with each other via the recessed portion.

6. The developer housing container according to claim 3, wherein a notched portion extending along the first direction is formed in the sealing member, and when the moving wall reaches a position opposed to the recessed portion, compression of the sealing member is released to cause the notched portion to form a vent path, so that the housing space and the internal space upstream of the moving wall in the first direction communicate with each other via the vent path.

7. The developer housing container according to claim 6, wherein the container main body has a top which defines an upper face portion of the internal space, and the recessed portion is formed in the top of the container main body, and the notched portion is formed, in the sealing member, in a part below the recessed portion so as to have a V-shape along the first direction.

8. The developer housing container according to claim 1, wherein the communicating mechanism is a protrusion provided to protrude from the inner circumference surface of the container main body, and when the moving wall reaches a position opposed to the protrusion, the protrusion partly deforms the sealing member so that the housing space and the internal space upstream of the moving wall in the first direction to communicate with each other.

9. An image forming device comprising:

the developer housing container according to claim 1;

an image carrier with a surface on which an electrostatic latent image is formed, the image carrier carrying a developer image;

a developing device which is replenished with the developer from the developer housing container and supplies the image carrier with the developer; and a transfer portion which transfers the developer image from the image carrier to a sheet.

10. The image forming device according to claim 9, further comprising:

a driving portion which generates a driving force that causes the moving wall to move in the first direction; and a control unit which controls the driving portion, wherein the control unit controls the driving portion such that the moving wall passes a position opposed to the communicating mechanism, and the moving wall stops on a side downstream of the communicating mechanism in the first direction.

11. The image forming device according to claim 9, wherein the developing device includes:

a housing including a developer transport path on which the developer is transported in a predetermined transportation direction;

a developer replenishing port opened, in the housing, below the developer discharge port so as to receive the developer from the developer housing container into the developer transport path;

a developer transport member arranged on the developer transport path to transport the developer in the transportation direction; and a transport capacity suppressing portion provided downstream of the developer replenishing port in the transportation direction to partly suppress a transport capacity of the developer of the developer transport member in the transportation direction.

* * * * *